US012297715B2

(12) United States Patent
Al-Ramadhan et al.

(10) Patent No.: US 12,297,715 B2
(45) Date of Patent: May 13, 2025

(54) CONCENTRIC SMART WELL COMPLETION

(71) Applicant: Saudi Arabian Oil Company, Dhahran (SA)

(72) Inventors: Ahmed A. Al-Ramadhan, Dammam (SA); Ahmed Abdullah Al-Mousa, Dhahran (SA); Marius Neacsu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 61 days.

(21) Appl. No.: 18/316,101

(22) Filed: May 11, 2023

(65) Prior Publication Data

US 2024/0376799 A1 Nov. 14, 2024

(51) Int. Cl.

| | |
|---|---|
| ***E21B 34/16*** | (2006.01) |
| ***E21B 43/14*** | (2006.01) |
| *E21B 33/12* | (2006.01) |
| *E21B 43/12* | (2006.01) |

(52) U.S. Cl.

CPC ..... *E21B 34/16* (2013.01); *E21B 43/14* (2013.01); *E21B 33/12* (2013.01); *E21B 43/122* (2013.01)

(58) Field of Classification Search

None

See application file for complete search history.

(56) References Cited

U.S. PATENT DOCUMENTS

| | | | | |
|---|---|---|---|---|
| 4,399,865 | A * | 8/1983 | Anderson | E21B 36/00 166/57 |
| 4,459,731 | A | 7/1984 | Hutchison | |
| 6,179,056 | B1 | 1/2001 | Smith et al. | |
| 6,318,469 | B1 * | 11/2001 | Patel | E21B 43/12 166/305.1 |
| 6,932,156 | B2 * | 8/2005 | Bayne | E21B 43/14 166/278 |
| 7,104,324 | B2 | 9/2006 | Wetzel et al. | |
| RE40,648 | E | 3/2009 | Turner et al. | |
| 7,896,079 | B2 * | 3/2011 | Dyer | E21B 43/14 417/424.2 |
| 2012/0013482 | A1 * | 1/2012 | Patel | E21B 17/0283 340/854.8 |

OTHER PUBLICATIONS

Mahmood et al., "A Review on Smart Well Completion System: Route to the Smartest Recovery," International Conference on Petroleum Engineering (ICPE) 2016, BUET, Bangladesh, Dec. 2016, 11 pages.

Well Completion and Servicing, Institut Frangais du Petrole Publications, 1995, 174 pages.

* cited by examiner

*Primary Examiner* — David Carroll

(74) *Attorney, Agent, or Firm* — Fish & Richardson P.C.

(57) ABSTRACT

A method includes disposing a tubular production string in a wellbore, the string having an upper portion with inner diameter greater than the inner diameter of a lower portion of the string. A tubular insert is disposed within the production string uphole of the lower portion. Opening an upper interval control valve (ICV) on the production string permits a flow of fluids from an upper production zone through the upper ICV to the surface through an interior annular volume formed by the exterior of the tubular insert and the interior of the upper portion, and opening a lower ICV on the production string permits a flow of fluids from a lower production zone through the lower ICV to the surface through the tubular insert, simultaneously and without commingling with fluids flowing through the upper ICV.

23 Claims, 9 Drawing Sheets

CONCENTRIC SMART WELL COMPLETION

TECHNICAL FIELD

The present disclosure is directed to the production of oil, gas, or other resources from subterranean zones.

BACKGROUND

Subterranean zones from which oil, gas, or other fluids are produced can include multiple production zones, which may comprise different sedimentary layers, different rock formations, zones of different pressure regimes, or other divisions such that concurrent production of the fluids from multiple different productions zones is desired but for reasons of safety, pressure management, flow control, or other reasons it is desired to not commingle the fluids produced from, and to independently control fluid flow from, the individual production zones.

SUMMARY

Certain aspects of the subject matter herein can be implemented as a method for producing fluids from a wellbore drilled into a subterranean zone from a surface of the Earth. The subterranean zone includes at least an upper production zone and a lower production zone, and the method includes disposing in the wellbore a tubular production string that includes an upper string portion and a lower string portion, an inner diameter of a central bore of the upper string portion greater than an inner diameter of a central bore of the lower string portion. Joining a downhole end of the upper string portion with an uphole end of the lower string portion is a crossover assembly including a seal receptacle configured to receive a downhole end of a tubular insert having an outside diameter less than the inner diameter of the central bore of the upper string portion. The production string also includes an upper interval control valve (ICV) positioned on the production string and a lower ICV positioned on the production string downhole of the upper ICV. The method further includes positioning the production string within the wellbore such that the upper ICV is proximate an upper production zone perforation and the lower ICV is proximate a lower production zone perforation. After disposing the production string in the wellbore, a tubular insert is disposed within the central bore of the upper string portion and a downhole end of the tubular insert is inserted into the seal receptacle of the crossover assembly, thereby forming an interior annular volume defined at least in part by an inner surface of the central bore of the upper string portion, an outer surface of the tubular insert, and the seal receptacle. After inserting downhole end of the tubular insert into the seal receptacle, the upper ICV and the lower ICV are opened, thereby permitting a flow of fluids from the upper production zone through the upper ICV to the surface through the interior annular volume and also simultaneously permitting a flow of fluids from the lower production zone through the lower ICV to the surface through a central bore of the tubular insert via the central bore of the lower string portion without commingling with fluids flowing through the upper ICV.

An aspect combinable with any of the other aspects can include the following features. An inner diameter of the tubular insert can be substantially the same as the inner diameter of the central bore of the lower string portion.

An aspect combinable with any of the other aspects can include the following features. The downhole end of the tubular insert can be uphole of the uphole end of the lower string portion when the downhole end of the tubular insert is inserted into the seal receptacle.

An aspect combinable with any of the other aspects can include the following features. The crossover assembly can include a tapered surface configured to guide the downhole end of the tubular insert into the seal receptacle.

An aspect combinable with any of the other aspects can include the following features. The downhole end of the tubular insert can be releasably connected to the seal receptacle.

An aspect combinable with any of the other aspects can include the following features. The tubular insert can further include a sliding sleeve, and the method further includes, after the tubular insert is inserted in the seal receptacle, opening the sliding sleeve to permit flow of a lifting gas from the central bore of the tubular insert into the interior annular volume.

An aspect combinable with any of the other aspects can include the following features. The lifting gas can be pumped from a coiled tubing string disposed in the central bore of the tubular insert.

An aspect combinable with any of the other aspects can include the following features. Opening the upper ICV can be in response to a hydraulic signal conveyed to the upper ICV via a hydraulic control line extending downhole from a wellhead assembly.

An aspect combinable with any of the other aspects can include the following features. The hydraulic control line can be a first hydraulic control line and opening the lower ICV can be in response to a hydraulic signal conveyed to the lower ICV from a second hydraulic control line extending downhole from the wellhead assembly.

An aspect combinable with any of the other aspects can include the following features. The flow of fluids from the upper production zone through the upper ICV can be simultaneous with the flow of fluids from the lower production zone through the lower ICV.

An aspect combinable with any of the other aspects can include the following features. The production string can further include a production packer disposed around an exterior portion of the production string between the upper ICV and the lower ICV. Before inserting the downhole end of the tubular insert into the seal receptacle of the crossover assembly, the production packer can be set thereby isolating an annular volume exterior of the production string uphole of the production packer in fluid communication with the upper production zone perforation from an annular volume exterior of the production string downhole of the production packer in fluid communication with the lower production zone perforation.

Certain aspects of the subject matter herein can be implemented as a system for producing fluids from a wellbore drilled into a subterranean zone from a surface of the Earth that includes at least an upper production zone and a lower production zone. The system includes a tubular production string disposed in the wellbore, the tubular string including an upper string portion and a lower string portion, an inner diameter of a central bore of the upper string portion greater than an inner diameter of a central bore of the lower string portion. The production string further includes a crossover assembly joining a downhole end of the upper string portion with an uphole end of the lower string portion, the crossover assembly including a seal receptacle configured to receive a downhole end of a tubular insert having an outside diameter less than the inner diameter of the central bore of the upper string portion. The production string also includes upper interval control valve (ICV) positioned on the production string proximate an upper production zone perforation and a lower ICV positioned on the production string downhole of the upper ICV proximate a lower production zone perforation. The system further includes a tubular insert disposed within the central bore of the upper string portion, a downhole end of which is inserted into the seal receptacle of the crossover assembly, thereby forming an interior annular volume defined at least in part by an inner surface of the central bore of the upper string portion, an outer surface of the tubular insert, and the seal receptacle. The system is configured such that opening the upper ICV and the lower ICV permits a flow of fluids from the upper production zone through the upper ICV to the surface through the interior annular volume opening the lower ICV and, simultaneously, a flow of fluids from the lower production zone through the lower ICV to the surface through a central bore of the tubular insert via the central bore of the lower string portion without commingling with fluids flowing through the upper ICV.

An aspect combinable with any of the other aspects can include the following features. An inner diameter of the tubular insert can be substantially the same as the inner diameter of the central bore of the lower string portion.

An aspect combinable with any of the other aspects can include the following features. The downhole end of the tubular insert can be uphole of the uphole end of the lower string portion when the downhole end of the tubular insert is inserted into the seal receptacle.

An aspect combinable with any of the other aspects can include the following features. The crossover assembly can include a tapered surface configured to guide the downhole end of the tubular insert into the seal receptacle.

An aspect combinable with any of the other aspects can include the following features. The downhole end of the tubular insert can be releasably connected to the seal receptacle.

An aspect combinable with any of the other aspects can include the following features. The tubular insert further can include a sliding sleeve configured such that opening the sliding sleeve permits flow of a lifting gas from the central bore of the tubular insert into the interior annular volume.

An aspect combinable with any of the other aspects can include the following features. The lifting gas can be pumped from a coiled tubing string disposed in the central bore of the tubular insert.

An aspect combinable with any of the other aspects can include the following features. The system can also include a hydraulic control line configured to convey a hydraulic control signal to the upper ICV.

An aspect combinable with any of the other aspects can include the following features. The system can also include a hydraulic control line configured to convey a hydraulic control signal to the lower ICV.

An aspect combinable with any of the other aspects can include the following features. The flow of fluids from the upper production zone through the upper ICV can be simultaneous with the flow of fluids from the lower production zone through the lower ICV.

An aspect combinable with any of the other aspects can include the following features. The system can further include a production packer disposed around an exterior portion of the production string between the upper ICV and the lower ICV, the production packer isolating an annular volume exterior of the production string uphole of the production packer in fluid communication with the upper production zone perforation from an annular volume exterior of the production string downhole of the production packer in fluid communication with the lower production zone perforation. The tubular insert can disposed within the central bore of the upper string portion after the production packer is set.

DETAILED DESCRIPTION

In accordance with some embodiments of the present disclosure, a method and system which can enable an operator to produce fluids from one or more production zones without commingling them with fluids produced from other production zones, while selectively controlling flow of fluids from each zone. The method and system is simple, inexpensive, and efficient, and the system can be easily and efficiently constructed and removed (in whole or in part). The system also isolates the casing from any formation fluid by containing the two flow paths inside the inner tubing and the tubing-tubing annulus. This can protect the production casing from any corrosion or erosion induced by the flow in the casing-tubing annulus.

Figure 1:
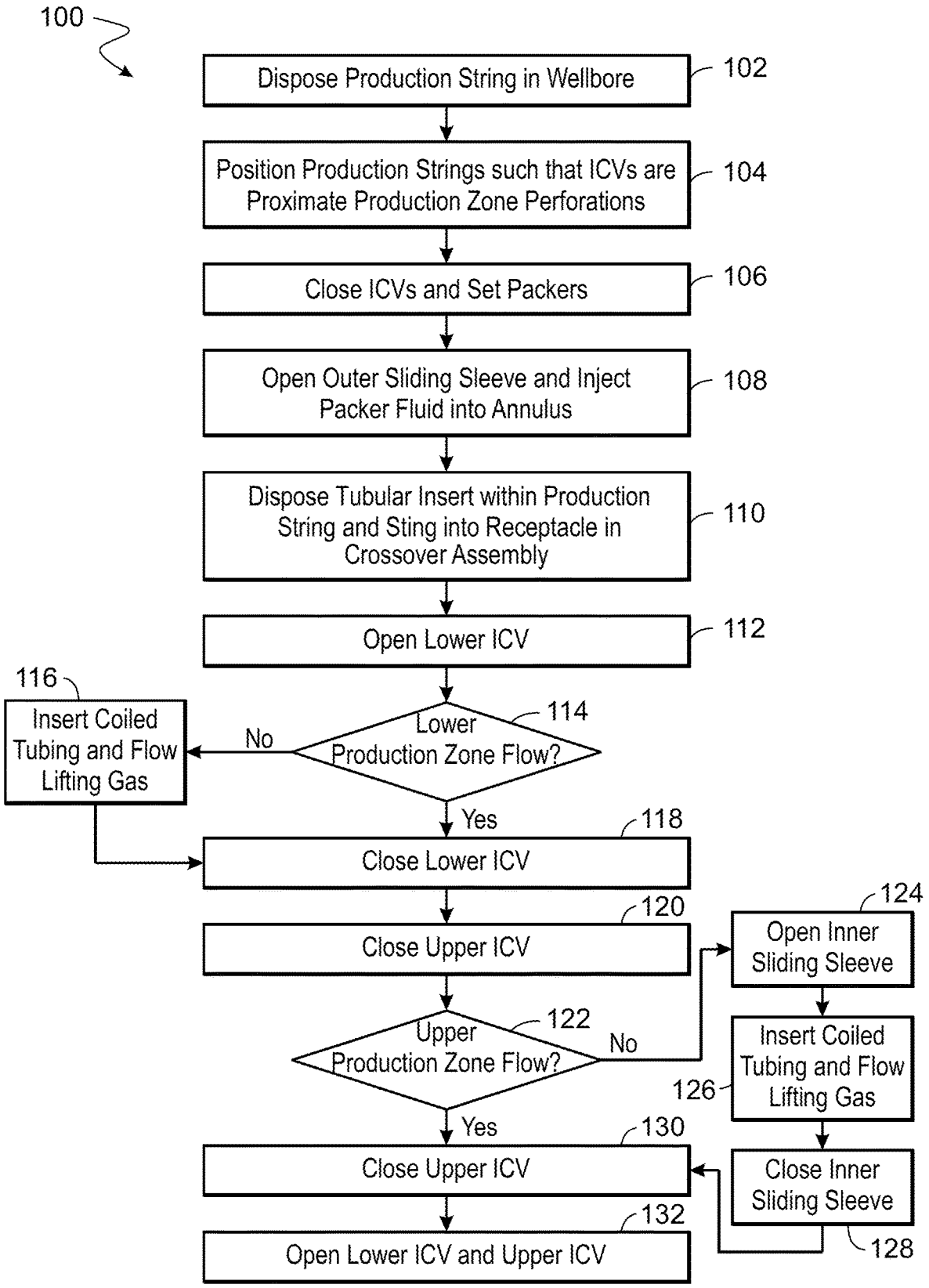
FIG. 1 is a process flow diagram of a method of producing fluids from a wellbore drilled into a subterranean zone from a surface of the Earth, in accordance with an embodiment of the present disclosure.

FIG. 1 is a process flow diagram of a method of producing fluids from a wellbore drilled into a subterranean zone from a surface of the Earth, in accordance with an embodiment of the present disclosure. FIGS. 2A-2G are schematic illustrations of a system of producing fluids from a wellbore drilled into a subterranean zone from a surface of the Earth, in accordance with an embodiment of the present disclosure. The process of FIG. 1 is described below in reference to the system of FIGS. 2A-2G, in accordance with an embodiment of the present disclosure.

Figure 2A:
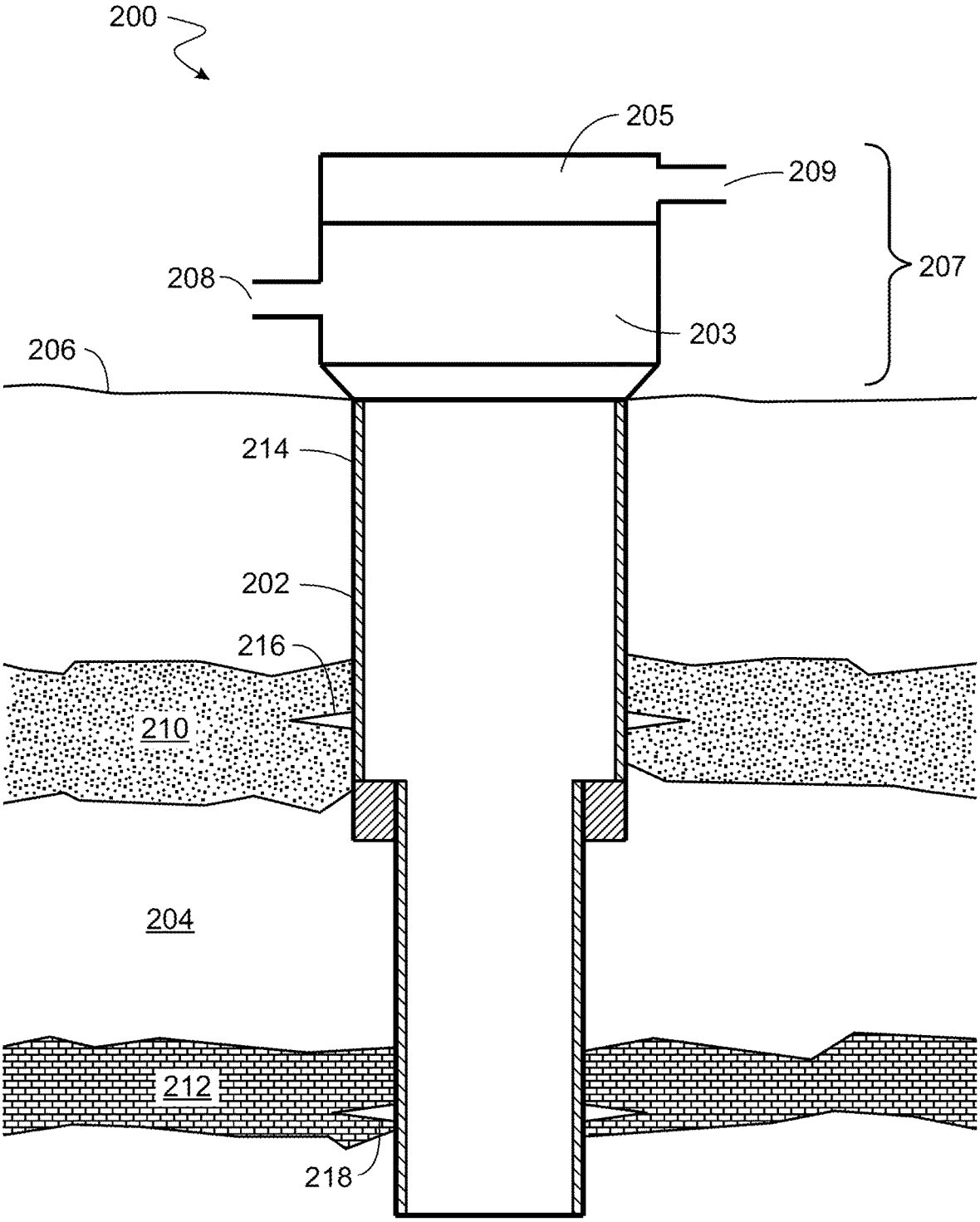
FIGS. 2A-2G are schematic illustrations of a wellbore system in accordance with some embodiments of the present disclosure.

Referring first to FIG. 2A, well system 200 includes a wellbore 202 drilled into a subterranean zone 204 from surface 206. Wellbore 102 can be a wellbore of an oil and/or gas well, water well, or other wellbore drilled into subterranean zone 104 for purposes of oil and/or gas production or other purposes or applications, and can be drilled from a surface (land) location or an offshore location. In the illustrated embodiment, wellbore 202 penetrates at least two production zones within subterranean zone 204: upper production zone 210 and lower production zone 212. Production zones 210 and 212 can comprise, for example, different reservoirs comprised of the same or different sedimentary rock formations or different zones within the same formation or reservoir, from which oil and/or gas and/or other materials is desired to be or can be produced. In some embodiments, production zones 210 and 212 can be partially or fully isolated from each other with respect to reservoir pressure and/or and fluid flow between them (by for example, by a layer of less permeable rock or other Earth material that exists between them), and/or can have different types or relative mixtures of fluids, such that it can be desirable to not commingle the fluids produced and/or to independently control fluid flow from them. In some embodiments, subterranean zone 204 can comprise only the two production zones or can comprise a greater number of production zones. The words "upper" and "lower" as used in the terms "upper production zone" and "lower production zone," respectively, refer to the position of the zones relative to each other along the wellbore, with upper production zone 210 closer to the surface of the Earth than lower production zone 212 along wellbore 202. Upper production zone 210 is not necessarily the uppermost production zone of subterranean zone 204. Likewise, lower production zone 212 is not necessarily the lowermost production zone of subterranean zone 204. Subterranean zone 104 may include, and wellbore 202 may penetrate, one or more other production zones along the wellbore above (uphole) of upper production zone 210, one or more other production zones between upper production zone 210 and lower production zone 212, and/or one or more other production zones below (downhole) of lower production zone 212. Wellbore 202 in the illustrated embodiment is substantially vertical; however, in some embodiments the wellbore can include both vertical and other-than-vertical (such as substantially horizontal) portions and can comprise a single wellbore or can include multiple (for example, lateral) wellbores. Well system 200 further includes a wellhead assembly 207, which can include various spools, valves, and adapters to provide pressure and flow control from wellbore 202. In the illustrated embodiment, wellhead assembly 207 includes spool outlet 208 extending from a lower spool 203 and spool outlet 209 extending from an upper spool 205.

In the illustrated embodiment, casing string 214 (which can be comprised of multiple tubular casing segments of varying diameters) has been installed and cemented in place within wellbore 202 to stabilize the wellbore in accordance with conventional methods.

To provide a pathway for oil, gas, or other materials to be produced from upper production zone 210 to enter wellbore 202, upper zone perforations 216 have been formed through casing 214 and into upper production zone 210. Likewise, to provide a pathway for oil, gas, or other materials to be produced from lower production zone 212 to enter wellbore 202, lower zone perforations 218 have been formed through casing 214 and into lower production zone 212. Perforations 216 and 218 can be formed, for example, via shaped explosive charges or other means.

Figure 2B:
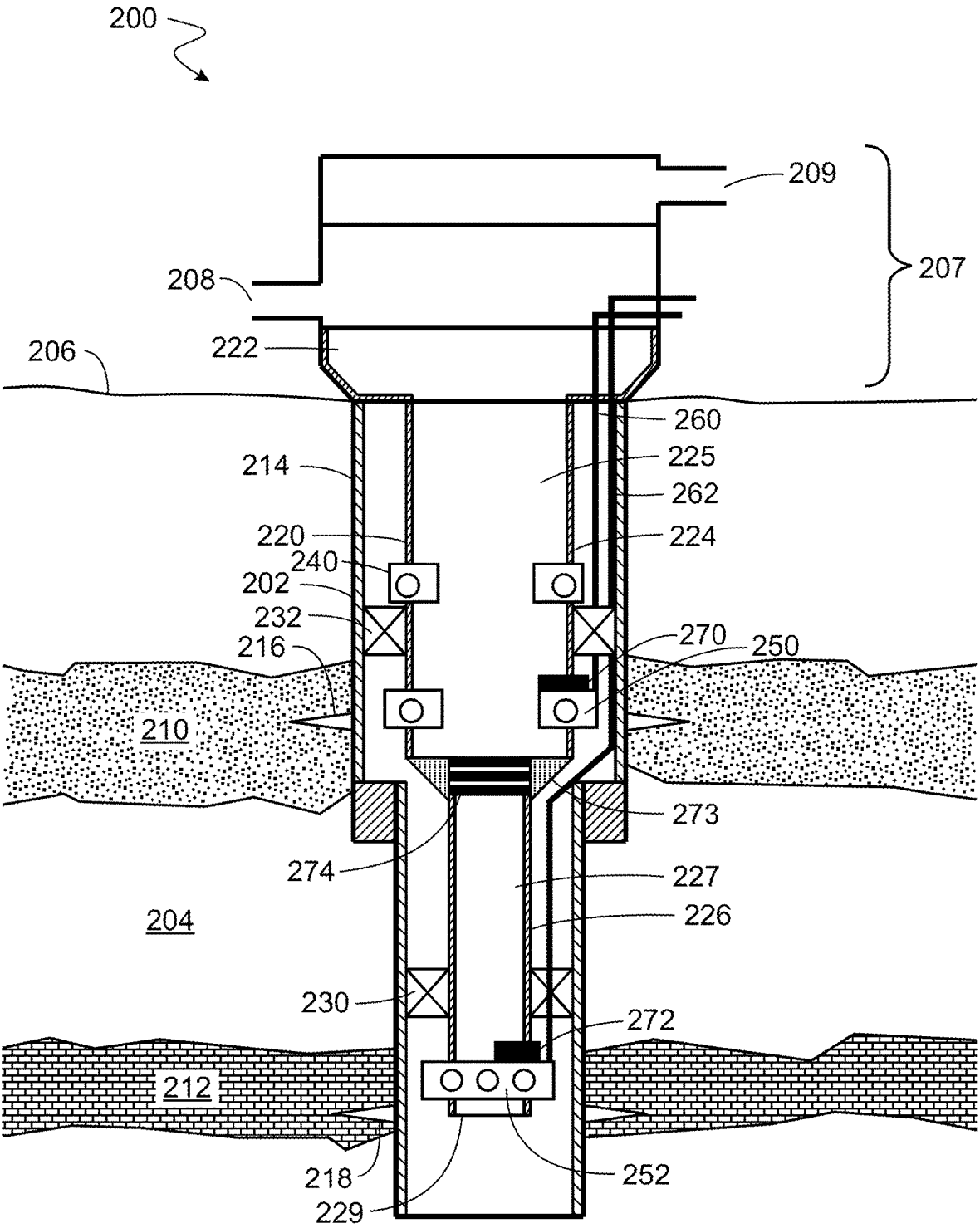

Referring now to FIG. 1, method 100 of FIG. 1 begins at step 102 in which, as shown in FIG. 2B, tubular production string 220 is disposed in wellbore 202, hung from tubing hanger 222 installed in lower tubing spool 203. Tubing hanger 222 can in some embodiments be an 11-inch by 7-inch external feed-through hanger. Production string 220 includes an upper string portion 224 (which in some embodiments can be a 7-inch OD (outer diameter) tubular) and a lower string portion 226 (which in some embodiments can be a 3½ inch OD tubular). The diameter of central bore 225 of upper string portion 224 is greater than the diameter of central bore 227 of lower string portion 226. Specifically, in some embodiments, the diameter of central bore 225 can be about 6 inches and the diameter of central bore 227 can be about 5 inches. At the downhole end of lower string portion 226 can be a 3½-inch closed-end bull plug 229

Production string 220 includes a crossover assembly 273 which joins the downhole end of the upper string portion 224 with an uphole end of the lower string portion 226. As described in more detail in reference to FIG. 3, crossover assembly 273 includes a seal receptacle 274 configured to receive a downhole end of a tubular insert having an outside diameter less than the inner diameter of the central bore of the upper string portion 224.

Production string 220 further includes an upper interval control valve (ICV) 250 positioned on production string 220 and a lower interval ICV 252 positioned on production string 220 positioned on production string 220 downhole of upper ICV 250. In some embodiments upper ICV 250 is a 7-inch ICV and lower ICV 252 is a 3½-inch ICV. A first hydraulic control line 260 is configured to transmit hydraulic signals (for example, an initiation, cessation, a change in hydraulic pressure, or a pressure cycling) to upper ICV 250 and second hydraulic control line 262 is configured to transmit hydraulic signals to lower ICV 252.

Production string 220 in the illustrated embodiment further includes two production packers: a first production packer 230 disposed around an exterior portion of production string 220 between upper ICV 250 and lower ICV 252 and a second production packer 232 disposed around an exterior portion of production string 220 uphole of upper ICV 250. Packers 230 and 232 can include feedthroughs through which control lines 260 and 262 can pass without compromising the pressure seal of the packers.

Production string 220 in the illustrated embodiment includes pressure and temperature gauges 270 and 272 to monitor the pressure and temperature of fluids flowing through ICVs 250 and 252, respectively. The pressure and temperature data can be used by an operator to analyze reservoir performance and to monitor control of production settings for the ICVs.

Production string 220 in the illustrated embodiment further includes a sliding sleeve 240 which can selectively provide fluid communication between central bore 225 and the tubing-casing annulus exterior of production string 220, uphole of packer 232.

Proceeding to step 104 of FIG. 1, the operator can position production string 220 at a desired downhole location within the wellbore. As shown in FIG. 2B, the locations of upper ICV 250 and lower ICV 252 along production string 220 in the illustrated embodiment is such that, when upper ICV 250 is positioned proximate to upper perforation, lower ICV 152 positioned proximate lower perforation 218, with packer 230 positioned between the production zones. Although the embodiment illustrated in FIGS. 2A-2C illustrate a subterranean zone with two production zones and two corresponding ICVs, it will be understood that other embodiments of the disclosure can include additional ICVs positioned proximate three, four, or a greater number of production zones from which fluids may be produced.

Proceeding to step 106 of FIG. 1, ICVs 250 and 252 are closed by pressure cycling and packers 230 and 232 are set by pressuring the tubing string against the bull plug at the downhole end. When set, packer 230 isolates the annular volume exterior of production string 220 uphole of packer 230 in fluid communication with upper production zone perforation 216 from an annular volume exterior of the production string 220 downhole of packer 230 in fluid communication with the lower production zone perforation 218. Likewise, when set, packer 232 isolates the annular volume exterior of production string 220 uphole of packer 232 from the annular volume downhole of packer 232. The setting of packers 230 and 232 can further act to prevent further uphole or downhole movement of production string 220, thus fixing string 220 in the desired downhole position. The upper production packer can be tested by applying pressure in the tubing-casing annulus to verify its proper sealing.

Figure 2C:
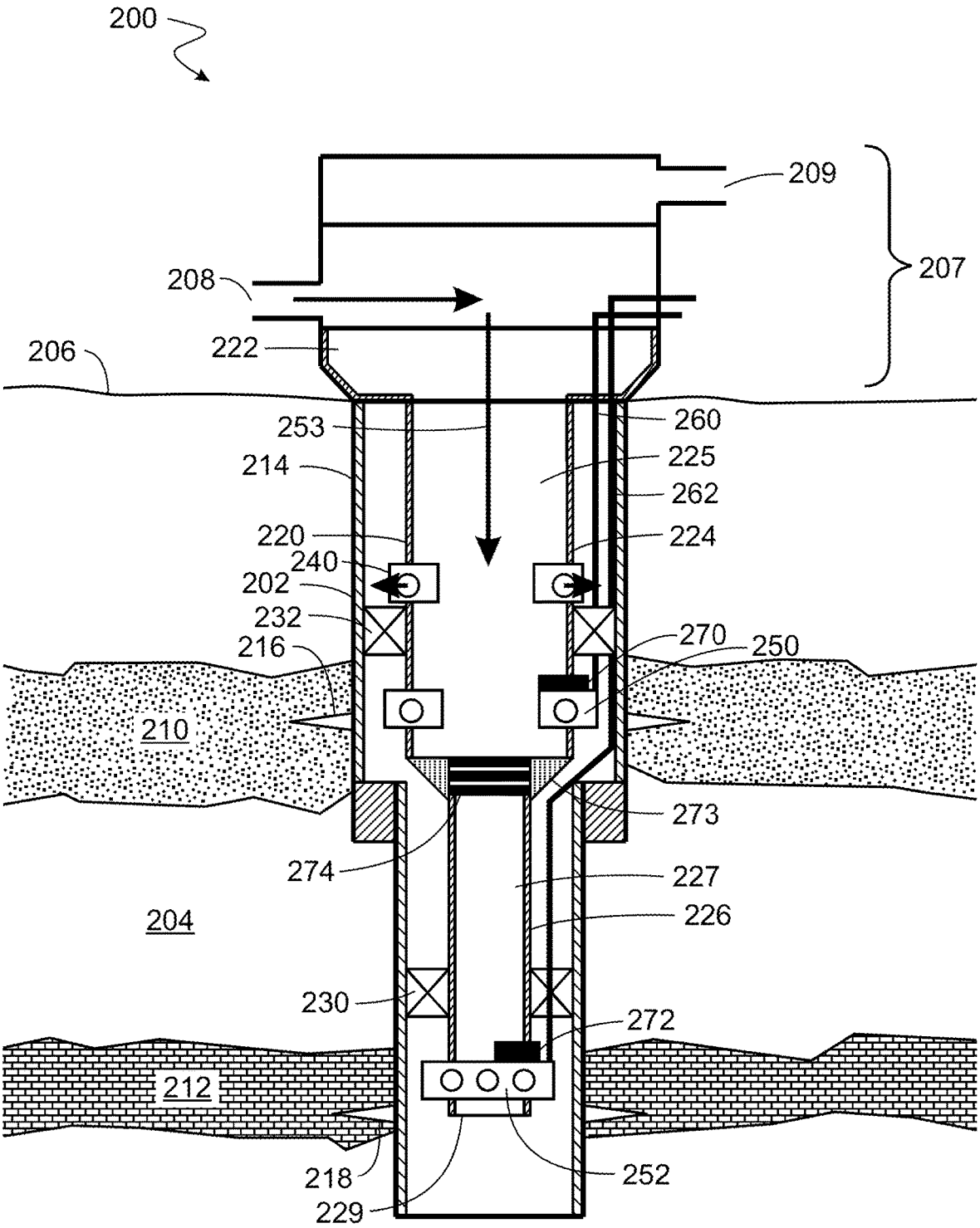

Proceeding to step 108 of FIG. 1, as shown in FIG. 2C, sliding sleeve 240 can be opened (for example, by slickline intervention) and a packer fluid 253 (such as diesel fluid or other corrosion-inhibiting fluid) can be injected and circulated into the tubing-casing annulus. After the circulating is complete, sliding sleeve 240 can be closed (again for example by slickline intervention).

Figure 2D:
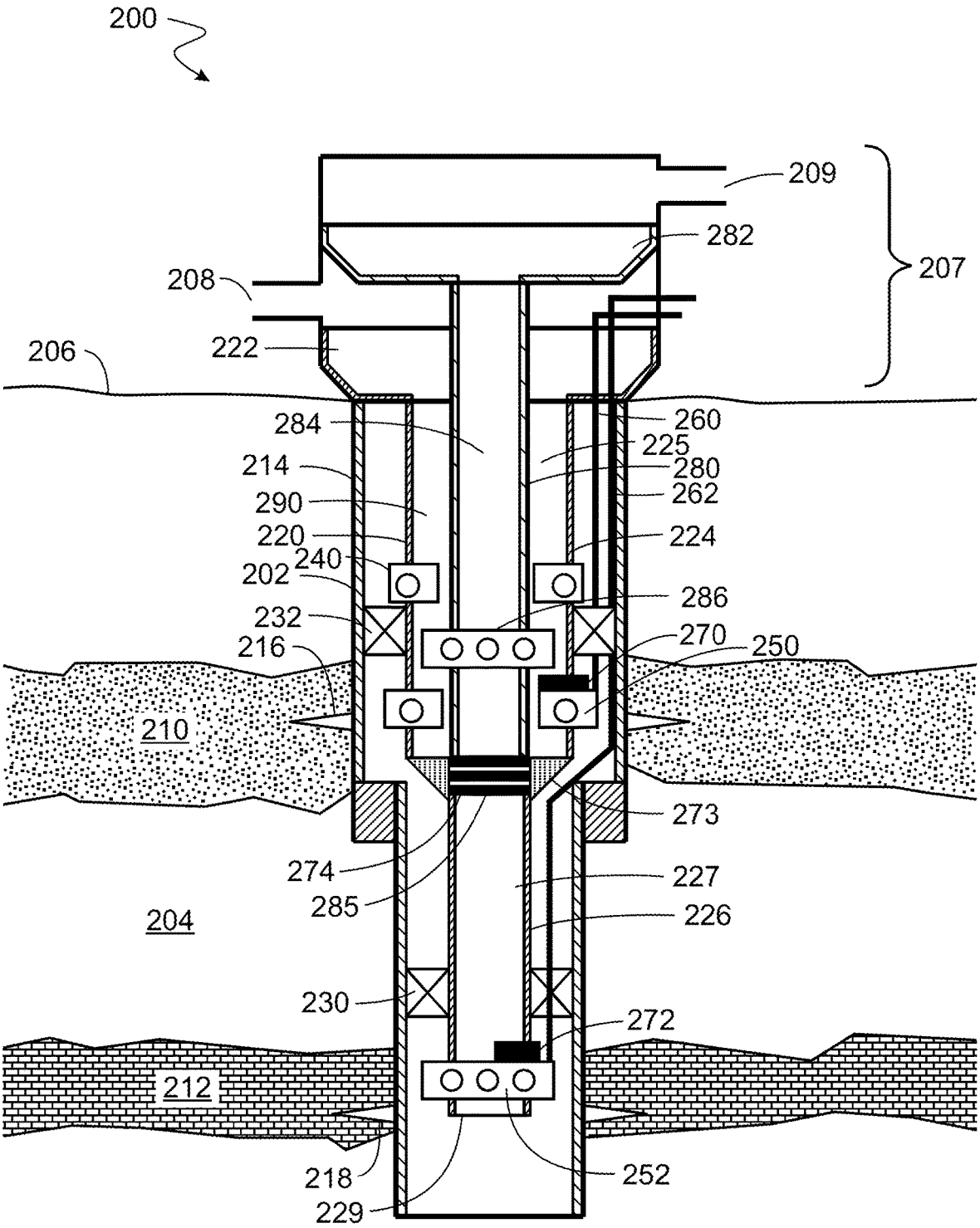

Proceeding to step 110 of FIG. 1, as shown in FIG. 2D, after setting the production packer, tubular insert 280 is disposed within central bore 225, uphole of the downhole end of upper string portion 224. Downhole end 285 of insert 280 is stung (inserted) into the seal receptacle 274 of the crossover assembly 273. Downhole end 285 of insert 280 can include seals, locks, and/or other components to form a suitable seal and to lock (for example, releasably lock) the connection between downhole end 285 and seal receptacle 274. In the illustrated embodiment, insert 280 can be hung from a tubing hanger 282 (which can be an 11-inch by 3½ inch tubing hanger) disposed within upper tubing spool 205. With insert 280 so positioned (with its downhole end inserted into seal receptacle 274), an interior annular volume 290 is formed defined at least in part by the inner surface of the central bore 225 of the upper string portion 224, the outer surface of tubular insert 280, and seal receptacle 274. In some embodiments, the diameter of inner bore 284 of tubular insert 280 can be the same or substantially the same as that of lower string portion 226 (for example, about 3 inches), thus forming a continuous bore of a similar or same inner diameter extending from lower ICV 252 to the surface, fluidically isolated from interior annular volume 290. Insert 280 in the illustrated embodiment further includes sliding sleeve 286 which can selectively provide fluid communication between tubular insert bore 284 and interior annular volume 290 (i.e., the portion of central bore 225 exterior of the external surface of insert 280). In some embodiments, an inhibiting fluid (such as diesel) can be pumped from bore 284 into interior annular volume 290 via sliding sleeve 286 to facilitate well flow-back operation.

Figure 2E:
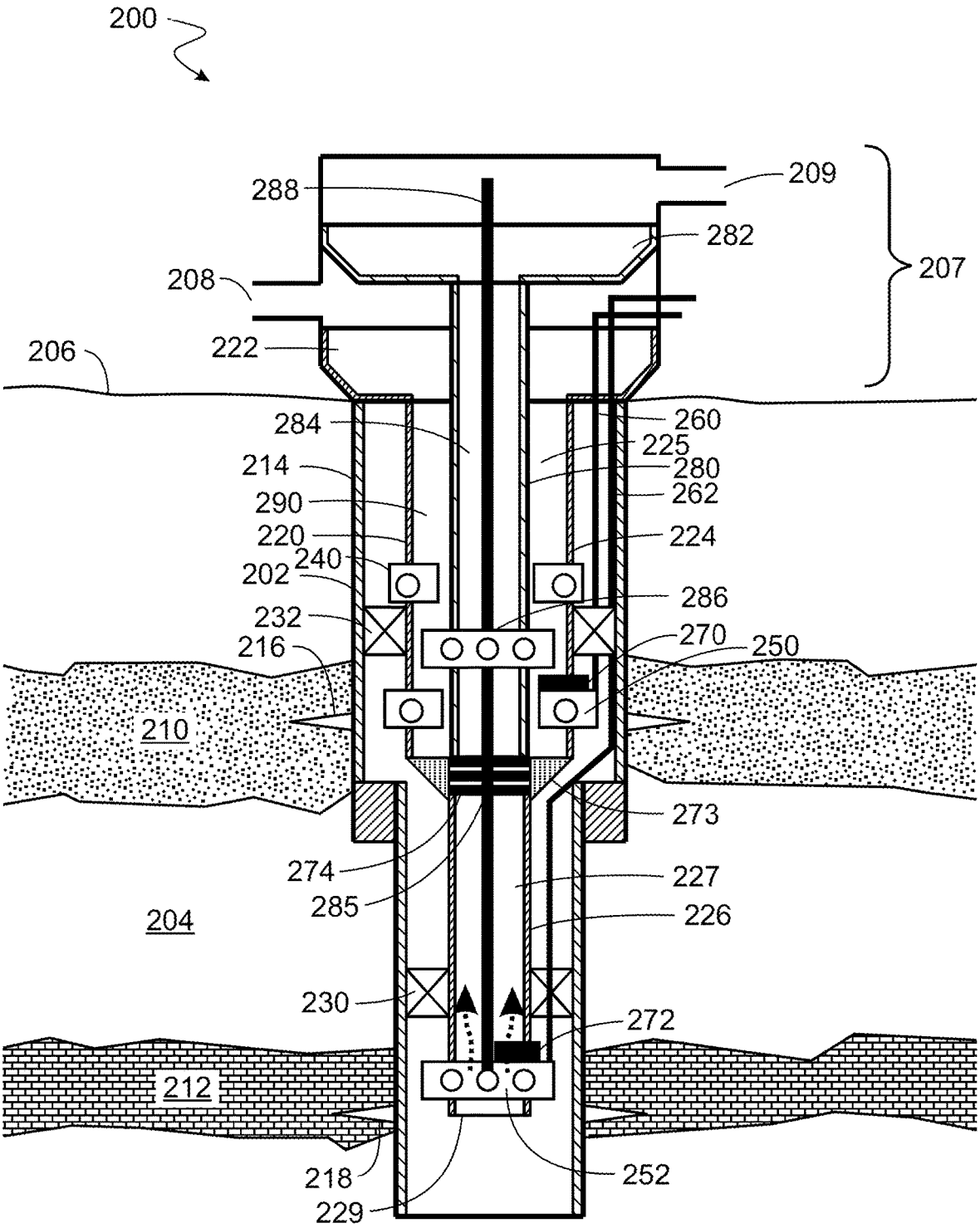

Proceeding to step 112 of FIG. 1, lower ICV 252 can be opened in response to a hydraulic signal from control line 262 and a production test performed to test production from lower production zone 212. If at step 114 the production test shows no, or less than desired, flow from lower production zone 212, then the method proceeds to step 116 in which, as shown in FIG. 2E, coiled tubing 288 can be inserted and a lifting gas (such as nitrogen gas) pumped into central bore 227 as shown in FIG. 2E to enhance production from lower zone 212.

After completion of the lifting gas injection of step 116, or if at step 114 the production test is positive (i.e., adequate flow from lower production zone 212 is observed), the method proceeds to step 118 in which lower ICV 252 is returned to a closed position.

Figure 2F:
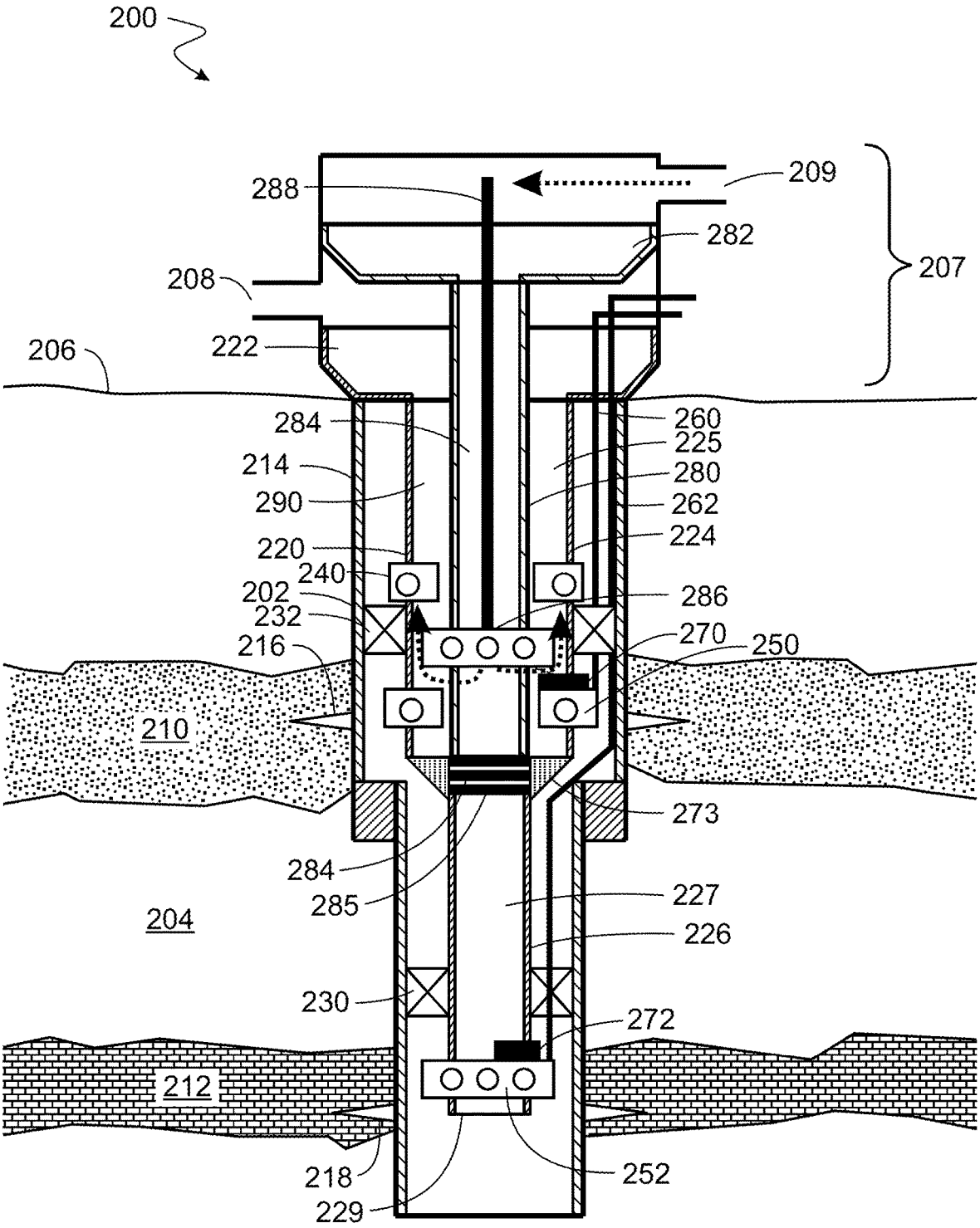

Proceeding to step 120 of FIG. 1, upper ICV 250 can be opened in response to a hydraulic signal from control line 260 and a production test performed to test production from upper production zone 210. If at step 122 the production test shows no, or less than desired, flow from upper production zone 210, then the method proceeds to step 124 in which inner sliding sleeve 286 is opened and, at step 126 and as shown in FIG. 2F, coiled tubing 288 can be inserted and a lifting gas (such as nitrogen gas) pumped into central bore 284 to enhance production from upper zone 210. Proceeding then to step 128, inner sliding sleeve 286 is closed and, after closing of inner sliding sleeve 286 at step 128, or if at step 122 the production test is positive (i.e., adequate flow from upper production zone 210 is observed), the method proceeds to step 130 in which upper ICV 250 is returned to a closed position.

Figure 2G:
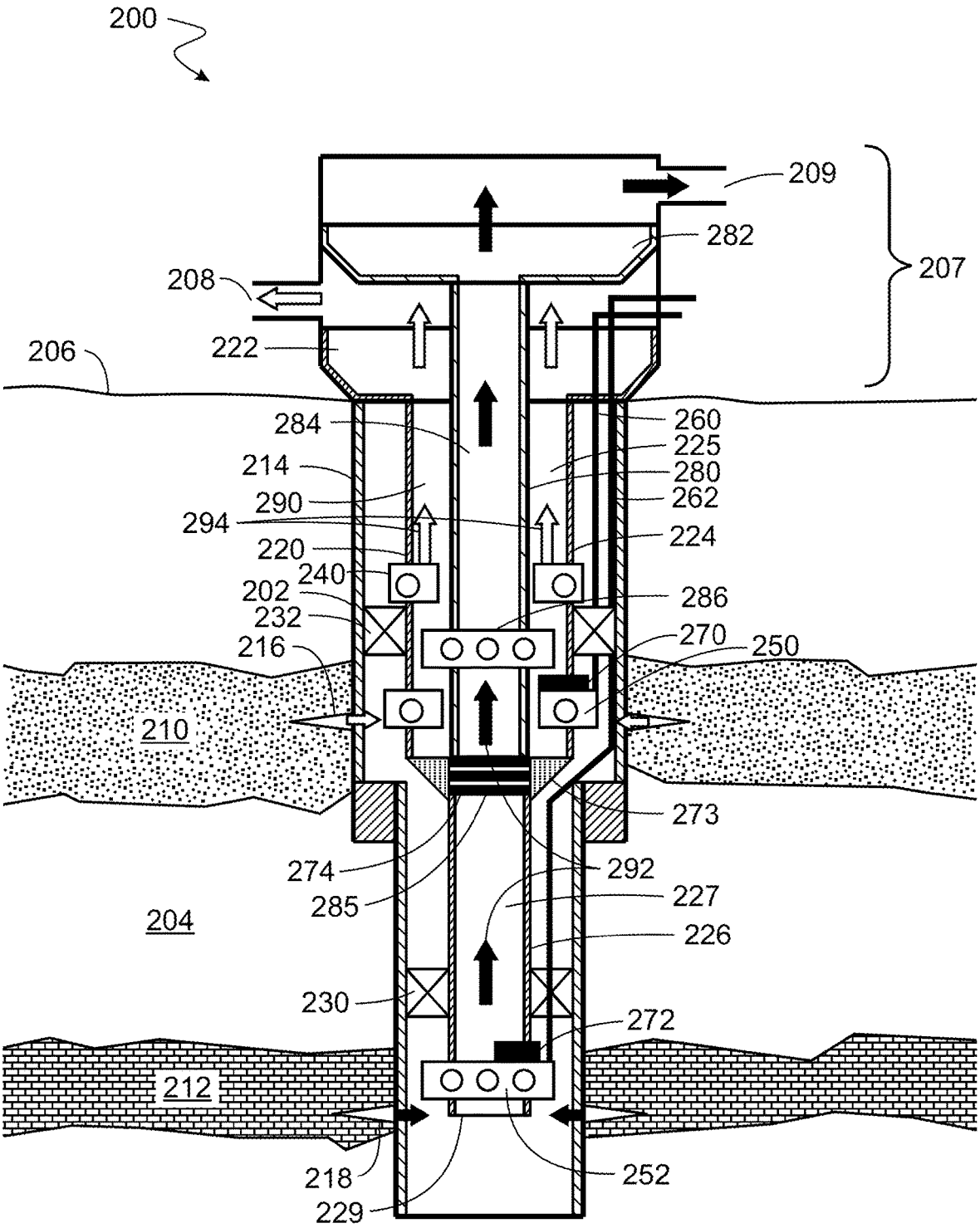

Proceeding then to step 132, and as shown in FIG. 2G, both lower ICV 252 and upper ICV 250 can be opened to their production settings and both the upper and lower zones produced simultaneously, with a flow 294 of fluids flowing from upper production zone perforation 216 through upper ICV 250 to the surface through the interior annular volume 290, and a flow 292 of fluids from lower production zone perforation 218 through lower ICV 252 to the surface through central bore 284 of tubular insert 280 via central bore 227 of the lower string portion 226 without commingling with fluids flowing through the upper ICV 250.

Figure 3:
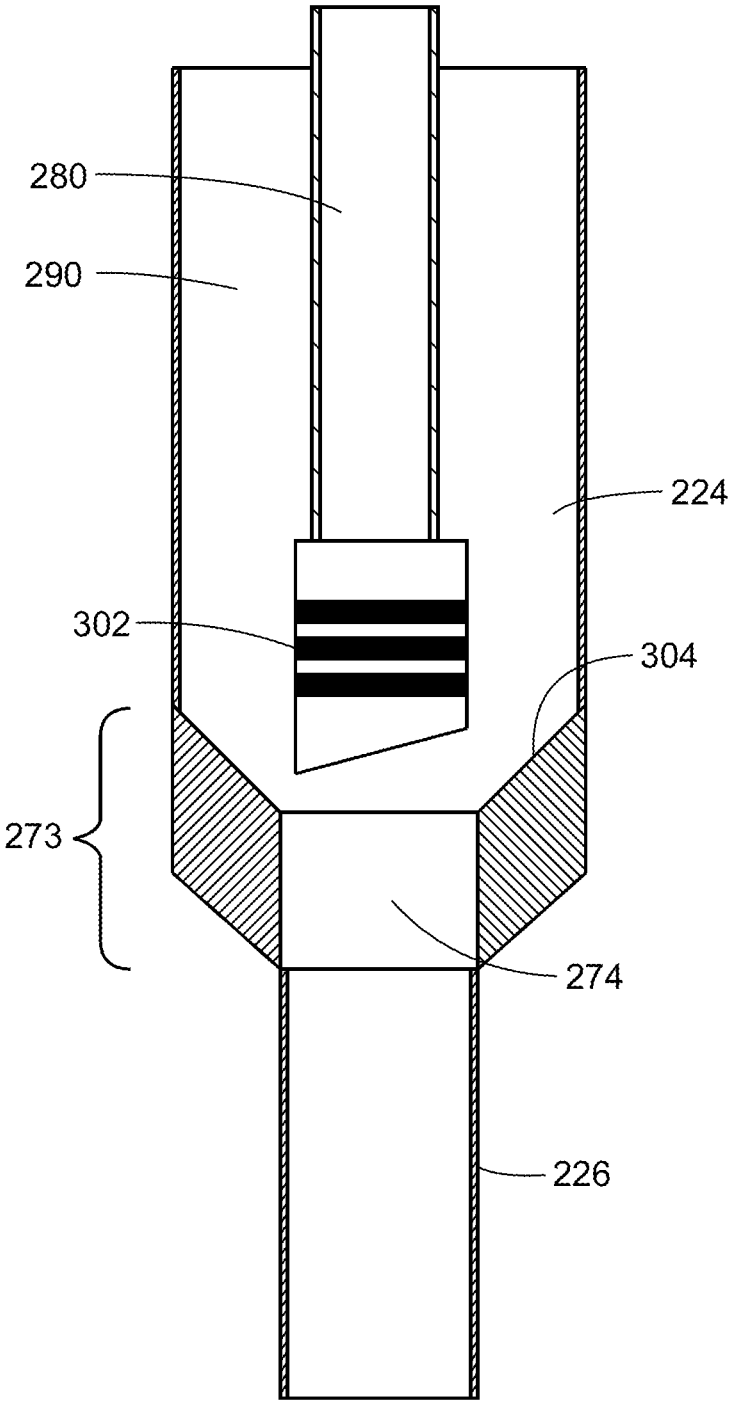
FIG. 3 is a schematic illustration of a crossover assembly including a seal receptacle in accordance with some embodiments of the present disclosure.

FIG. 3 is a schematic illustration of a crossover assembly 273 joining upper the downhole end of upper string portion 224 with the uphole end of lower string portion 226. Crossover assembly 273 can include a tapered surface 304 to guide seal stinger 302 at the downhole end of tubular insert 280 into seal receptacle 274, sealing the junction to forming a continuous inner bore fluidically isolated from the annular volume 290. In some embodiments, seal stinger 302 is releasably connected to seal receptacle 274 such that seal stinger 302 can be separated from seal receptacle 274 by an upward force, allowing tubular insert 280 to be removed from the well without the necessity of removing production string 220, allowing repairs or other remedial activities to take place without the expense or complexity of removing the entire completion assembly.

In this disclosure, "approximately" or "substantially" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

The term "uphole" as used herein means in the direction along a wellbore from its distal end towards the surface, and "downhole" as used herein means the direction along a wellbore from the surface towards its distal end. A downhole location means a location along a wellbore downhole of the surface.

What is claimed is:

1. A method for producing fluids from a wellbore drilled into a subterranean zone from a surface of the Earth, the subterranean zone comprising at least an upper production zone and a lower production zone, the method comprising:

disposing a tubular production string in the wellbore, the tubular string comprising:

an upper string portion and a lower string portion, an inner diameter of a central bore of the upper string portion greater than an inner diameter of a central bore of the lower string portion;

a crossover assembly joining a downhole end of the upper string portion with an uphole end of the lower string portion, the crossover assembly comprising a seal receptacle configured to receive a downhole end of a tubular isolation insert having an outside diameter less than the inner diameter of the central bore of the upper string portion;

an upper interval control valve (ICV) positioned on the production string;

a lower ICV positioned on the production string downhole of the upper ICV;

positioning the production string within the wellbore such that the upper ICV is proximate an upper production zone perforation and the lower ICV is proximate a lower production zone perforation;

after disposing the production string in the wellbore, disposing a tubular isolation insert within the central bore of the upper string portion and inserting a downhole end of the tubular isolation insert into the seal receptacle of the crossover assembly, thereby forming an interior annular volume defined at least in part by:

an inner surface of the central bore of the upper string portion;

an outer surface of the tubular isolation insert; and the seal receptacle; and after inserting downhole end of the tubular isolation insert into the seal receptacle:

opening the upper ICV, thereby permitting a flow of fluids from the upper production zone through the upper ICV to the surface through the interior annular volume; and opening the lower ICV, thereby permitting a flow of fluids from the lower production zone through the lower ICV to the surface through a central bore of the tubular isolation insert via the central bore of the lower string portion without commingling with fluids flowing through the upper ICV.

2. The method of claim 1, wherein an inner diameter of the tubular isolation insert is substantially the same as the inner diameter of the central bore of the lower string portion.

3. The method of claim 1, wherein the downhole end of the tubular isolation insert is uphole of the uphole end of the lower string portion when the downhole end of the tubular isolation insert is inserted into the seal receptacle.

4. The method of claim 1, wherein the crossover assembly comprises a tapered surface configured to guide the downhole end of the tubular isolation insert into the seal receptacle.

5. The method of claim 1, wherein the downhole end of the tubular isolation insert is releasably connected to the seal receptacle.

6. The method of claim 1, wherein the tubular isolation insert further comprises a sliding sleeve, and wherein the method further comprises, after the tubular isolation insert is inserted in the seal receptacle, opening the sliding sleeve to permit flow of a lifting gas from the central bore of the tubular isolation insert into the interior annular volume.

7. The method of claim 1, wherein opening the upper ICV is in response to a hydraulic signal conveyed to the upper ICV via a hydraulic control line extending downhole from a wellhead assembly.

8. The method of claim 7, wherein the hydraulic control line is a first hydraulic control line and wherein opening the lower ICV is in response to a hydraulic signal conveyed to the lower ICV from a second hydraulic control line extending downhole from the wellhead assembly.

9. The method of claim 1, wherein the flow of fluids from the upper production zone through the upper ICV is simultaneous with the flow of fluids from the lower production zone through the lower ICV.

10. The method of claim 1, wherein the production string further comprises a production packer disposed around an exterior portion of the production string between the upper ICV and the lower ICV, and further comprising, before inserting the downhole end of the tubular isolation insert into the seal receptacle of the crossover assembly, setting the production packer, thereby isolating an annular volume exterior of the production string uphole of the production packer in fluid communication with the upper production zone perforation from an annular volume exterior of the production string downhole of the production packer in fluid communication with the lower production zone perforation.

11. A system for producing fluids from a wellbore drilled into a subterranean zone from a surface of the Earth, the subterranean zone comprising at least an upper production zone and a lower production zone, the system comprising:

a tubular production string disposed in the wellbore downhole of a surface wellhead assembly, the tubular string comprising:

an upper string portion and a lower string portion, an inner diameter of a central bore of the upper string portion greater than an inner diameter of a central bore of the lower string portion;

a crossover assembly joining a downhole end of the upper string portion with an uphole end of the lower string portion, the crossover assembly comprising a seal receptacle configured to receive a downhole end of a tubular isolation insert having an outside diameter less than the inner diameter of the central bore of the upper string portion;

an upper interval control valve (ICV) positioned on the production string proximate an upper production zone perforation;

a lower ICV positioned on the production string downhole of the upper ICV proximate a lower production zone perforation; and a tubular isolation insert disposed within the central bore of the upper string portion, a downhole end of which is inserted into the seal receptacle of the crossover assembly, thereby forming an interior annular volume defined at least in part by:

an inner surface of the central bore of the upper string portion;

an outer surface of the tubular isolation insert; and the seal receptacle;

wherein the system is configured such that:

opening the upper ICV permits a flow of fluids from the upper production zone through the upper ICV to the surface wellhead assembly through the interior annular volume; and opening the lower ICV permits a flow of fluids from the lower production zone through the lower ICV to the surface wellhead assembly through a central bore of the tubular isolation insert via the central bore of the lower string portion, the tubular isolation insert preventing a commingling of fluids flowing through the lower ICV to the surface wellhead assembly with fluids flowing through the upper ICV to the surface wellhead assembly.

12. The system of claim 11, wherein an inner diameter of the tubular isolation insert is substantially the same as the inner diameter of the central bore of the lower string portion.

13. The system of claim 11, wherein the downhole end of the tubular isolation insert is uphole of the uphole end of the lower string portion when the downhole end of the tubular isolation insert is inserted into the seal receptacle.

14. The system of claim 11, wherein the crossover assembly comprises a tapered surface configured to guide the downhole end of the tubular isolation insert into the seal receptacle.

15. The system of claim 11, wherein the downhole end of the tubular isolation insert is releasably connected to the seal receptacle.

16. The system of claim 11, wherein the tubular isolation insert further comprises a sliding sleeve configured such that opening the sliding sleeve permits flow of a lifting gas from the central bore of the tubular isolation insert into the interior annular volume.

17. The system of claim 11, wherein a lifting gas is pumped from a coiled tubing string disposed in the central bore of the tubular isolation insert.

18. The system of claim 11, further comprising a hydraulic control line configured to convey a hydraulic control signal to the upper ICV.

19. The system of claim 11, further comprising a hydraulic control line configured to convey a hydraulic control signal to the lower ICV.

20. The system of claim 11, wherein the tubular isolation insert prevents the commingling while the flow of fluids from the upper production zone through the upper ICV is simultaneous with the flow of fluids from the lower production zone through the lower ICV.

21. The system of claim 11, further comprising a production packer disposed around an exterior portion of the production string between the upper ICV and the lower ICV, the production packer isolating an annular volume exterior of the production string uphole of the production packer in fluid communication with the upper production zone perforation from an annular volume exterior of the production string downhole of the production packer in fluid communication with the lower production zone perforation, wherein the tubular isolation insert is disposed within the central bore of the upper string portion after the production packer is set.

22. A system for producing fluids from a wellbore drilled into a subterranean zone from a surface of the Earth, the subterranean zone comprising at least an upper production zone and a lower production zone, the system comprising:

a tubular production string disposed in the wellbore downhole of a surface wellhead assembly, the tubular string comprising:

an upper string portion and a lower string portion, an inner diameter of a central bore of the upper string portion greater than an inner diameter of a central bore of the lower string portion;

a crossover assembly joining a downhole end of the upper string portion with an uphole end of the lower string portion, the crossover assembly comprising a seal receptacle configured to receive a downhole end of a tubular isolation insert having an outside diameter less than the inner diameter of the central bore of the upper string portion;

an upper interval control valve (ICV) positioned on the production string proximate an upper production zone perforation;

a lower ICV positioned on the production string downhole of the upper ICV proximate a lower production zone perforation; and a tubular isolation insert disposed within the central bore of the upper string portion, a downhole end of which is inserted into the seal receptacle of the crossover assembly such that the downhole end of the tubular isolation insert is uphole of the uphole end of the lower string portion when the downhole end of the tubular isolation insert is inserted into the seal receptacle, thereby forming an interior annular volume defined at least in part by:

an inner surface of the central bore of the upper string portion;

an outer surface of the tubular isolation insert; and the seal receptacle;

wherein the system is configured such that:

opening the upper ICV permits a flow of fluids from the upper production zone through the upper ICV to the surface wellhead assembly through the interior annular volume; and opening the lower ICV permits a flow of fluids from the lower production zone through the lower ICV to the surface wellhead assembly through a central bore of the tubular ISOLATION insert via the central bore of the lower string portion, without commingling with fluids flowing through the upper ICV.

23. A system for producing fluids from a wellbore drilled into a subterranean zone from a surface of the Earth, the subterranean zone comprising at least an upper production zone and a lower production zone, the system comprising:

a tubular production string disposed in the wellbore downhole of a surface wellhead assembly, the tubular string comprising:

an upper string portion and a lower string portion, an inner diameter of a central bore of the upper string portion greater than an inner diameter of a central bore of the lower string portion;

a crossover assembly joining a downhole end of the upper string portion with an uphole end of the lower string portion, the crossover assembly comprising a seal receptacle configured to receive a downhole end of a tubular isolation insert having an outside diameter less than the inner diameter of the central bore of the upper string portion;

an upper interval control valve (ICV) positioned on the production string proximate an upper production zone perforation;

a lower ICV positioned on the production string downhole of the upper ICV proximate a lower production zone perforation; and a tubular isolation insert disposed within the central bore of the upper string portion, a downhole end of which is inserted into the seal receptacle of the crossover assembly, thereby forming an interior annular volume defined at least in part by:

an inner surface of the central bore of the upper string portion;

an outer surface of the tubular isolation insert; and the seal receptacle;

wherein the tubular isolation insert further comprises a sliding sleeve configured such that opening the sliding sleeve permits flow of a lifting gas from the central bore of the tubular isolation insert into the interior annular volume and wherein the system is configured such that:

opening the upper ICV permits a flow of fluids from the upper production zone through the upper ICV to the surface wellhead assembly through the interior annular volume; and opening the lower ICV permits a flow of fluids from the lower production zone through the lower ICV to the surface wellhead assembly through a central bore of the tubular isolation insert via the central bore of the lower string portion, without commingling with fluids flowing through the upper ICV.

* * * * *